United States Patent [19]

Altenschoepfer et al.

[11] Patent Number: 4,818,427

[45] Date of Patent: Apr. 4, 1989

[54] PRETREATMENT OR STEEPING PREPARATIONS FOR STUBBORNLY SOILED DISHES AND A PROCESS FOR WASHING SUCH DISHES

[75] Inventors: Theodor Altenschoepfer, Duesseldorf; Peter Jeschke, Neuss; Klaus-Dieter Wisotzki, Erkrath, all of Fed. Rep. of Germany

[73] Assignee: Henkel Kommanditgesellschaft auf Aktien, Duesseldorf, Fed. Rep. of Germany

[21] Appl. No.: 110,141

[22] Filed: Oct. 19, 1987

[30] Foreign Application Priority Data

Oct. 18, 1986 [DE] Fed. Rep. of Germany ..... 3635535

[51] Int. Cl.[4] ..... C11D 3/43; C11D 3/60

[52] U.S. Cl. ..... 252/174.21; 134/40; 252/142; 252/143; 252/170; 252/171; 252/174.19

[58] Field of Search ..... 252/142, 143, 170, 171, 252/174.19, 174.21; 134/40

[56] References Cited

U.S. PATENT DOCUMENTS 3,592,774 7/1971 Altenschopfer ..... 252/89
4,116,851 9/1978 Rupe et al. ..... 252/103
4,465,612 8/1984 Altenschopfer et al. ..... 252/143
4,521,326 6/1985 Seibert et al. ..... 252/174.21

FOREIGN PATENT DOCUMENTS 975605 10/1962 United Kingdom .

*Primary Examiner*—Paul Lieberman
*Assistant Examiner*—Ronald A. Krasnow
*Attorney, Agent, or Firm*—Ernest G. Szoke; Wayne C. Jaeschke; Real J. Grandmaison

[57] ABSTRACT

A pretreatment or steeping preparation for cleaning stubbornly soiled dishes in an automatic dishwashing machine comprising from about 0.5 to about 20% by weight of a low-foaming nonionic surfactant, from about 0.5 to about 25% by weight of a polyhydric alcohol and/or glycol ether, from about 0.5 to about 10% by weight of a hydrotropic compound, and from about 0.01 to about 6% by weight of a viscosity regulator, all weights based on the weight of said preparation, in an aqueous suspension or solution adjusted to a viscosity of at least 5 mPa.s. and to a pH of from about 2 to about 7. In the cleaning process, the preparation is applied to the soiled dishes, the dishes are placed in an automatic dishwashing machine, and after waiting about 30 minutes the dishwashing machine is started for the normal washing cycle.

6 Claims, No Drawings

PRETREATMENT OR STEEPING PREPARATIONS FOR STUBBORNLY SOILED DISHES AND A PROCESS FOR WASHING SUCH DISHES

BACKGROUND OF THE INVENTION

1. Field of the Invention

This invention relates to a preparation for pretreating or steeping stubbornly soiled dishes and a process for washing such dishes therewith.

2. Discussion of Related Art

It is known that dishwashing machines use alkaline detergent mixtures which consist essentially of inorganic salts, such as alkali metal phosphates, alkali metal silicates and alkali metal carbonates, and active chlorine donors and which optionally contain small additions of a low-foam nonionic surfactant to improve wetting. Detergent mixtures such as these generally show good detergency with respect to soil of all kinds at normal washing temperatures of from 55° C. to 65° C. However, difficulties are encountered in the dishwashing process when the soil to be removed consists of burnt-on or dried-out, protein- and/or starch-containing food remains and white or grey coatings on the items to be washed which are largely attributable to alkaline-insoluble, inorganic calcium salts and which emanate on the one hand from the foods themselves and, on the other hand, from the water used in the preparation thereof. These soil types are not always completely removed in the dishwashing process, resulting in complaints on the part of the user or causing the user not to wash these items in the machine.

Accordingly, an object of the present invention is to provide a pretreatment or steeping preparation which is easy to use and which leads to the complete removal of problem soils in automatic dishwashing machines. Although U.S. Pat. No. 4,116,851 describes pasty, thixotropic, highly alkaline pot-cleaning detergents which contain various thickeners and active chlorine compounds and which, for practical application, are applied to the items to be washed and are submerged in water, remaining at the point of contact for a relatively long time by virtue of their gel structure so that they have a particularly long-lasting effect, there is nothing in said patent to suggest that preparations of the type described in the present invention would be suitable for use as a pretreatment or steeping preparation in dishwashing machines.

On the one hand, the contact time of the subject preparation should be kept as short as possible in order to not delay work programs. However, even if on the other hand, the items to be washed after treatment with the preparation have to stand for relatively long periods of time during collection in the dishwashing machine, food remains should be prevented from drying out again together with the preparation. The preparation according to the invention should be used by the user bringing the stubborn food remains, for example in a cooking pot or a frying pan, into contact with the preparation, for example by spray pumps, brushes, foam guns, aerosol cans, then immediately placing the items to be washed in the best position in the washing machine, i.e. with the pot opening facing downwards towards the water jet, most of the viscous product adhering to the surface of the pot, and starting the dishwashing program as required. There should be no need for the pretreatment or steeping preparation to be rinsed out before the dishwashing process.

DESCRIPTION OF THE INVENTION

Other than in the operating examples, or where otherwise indicated, all numbers expressing quantities of ingredients or reaction conditions used herein are to be understood as modified in all instances by the term "about".

The pretreatment and steeping preparation according to the invention for stubbornly soiled dishes for the complete removal of problem soils in automatic machine dishwashing comprises from 0.5 to 20% by weight, and preferably from 1 to 15% by weight, of a low-foaming nonionic surfactant, from 0.5 to 25% by weight, and preferably from 1 to 20% by weight, of a polyhydric aliphatic alcohol and/or glycol ether, from 0.5 to 10% by weight, and preferably from 1 to 8% by weight, of a hydrotropic compound, and from 0.01 to 6% by weight, and preferably from 0.05 to 5% by weight, of a viscosity regulator, all weights based on the weight of the preparation, in an aqueous suspension or solution adjusted to a viscosity of at least 5 mPa.s., and preferably at least 20 mPa.s.

It is also possible to add to the preparation other typical detergent ingredients, more especially perfumes and dyes, preservatives and very small quantities of acidic or alkaline agents for the required pH adjustment to between pH 2 and pH 7, and preferably to between pH 3 and pH 6, the water content of the preparation as a whole being reduced accordingly.

Suitable nonionic, preferably low-foam, surfactants include adducts of ethylene oxide with relatively high molecular weight propylene glycols having molecular weights of from 900 to 4000 and adducts of from 1 to 10 moles ethylene oxide, or of 1 to 10 moles ethylene oxide and 1 to 7 moles propylene oxide with relatively high molecular weight fatty alcohols containing from 8 to 22 and preferably from 10 to 16 carbon atoms in the molecule or naturally occurring mixtures thereof, and also synthetic $C_{12}$–$C_{18}$ alcohols, for example prepared by oxo synthesis, and corresponding alkylene oxide adducts with nonyl phenols. It is preferred to use the most biodegradable adducts of ethylene oxide and propylene oxide with relatively high molecular weight fatty alcohols, more especially the adduct of from 2 to 5 moles ethylene oxide and from 2 to 5 moles propylene oxide with a mixture of $C_{12}$–$C_{18}$ fatty alcohols. The terminal hydroxy groups of the adducts may also be converted into acetals or ketals ("terminal-group-blocked") by reaction of one mole of an aldehyde or ketone with two moles of an adduct. Ethoxylated diols containing up to 18 carbon atoms and terminal or internal vicinal hydroxyl groups and the corresponding monoglycol ether diols may also be used.

Suitable humectants, which are added to the formulations according to the invention to prevent them from drying out with the stubborn soils, include polyhydric aliphatic alcohols or glycol ethers and mixtures thereof, such as for example ethylene glycol, diethylene glycol, propylene glycol, dipropylene glycol or diethylene glycol monobutylether. The preferred humectant is glycerol.

Suitable solution promoters, i.e., hydrotropic compounds, include short-chain monohydric alcohols containing from 2 to 4 carbon atoms in the molecule, for example ethanol, propanol, butanol, or preferably, isopropanol, or hydrotropes, for example octylsulfate, benzene, xylene, toluene or cumene sulfonate or polydiols having a molecular weight of up to 1000.

The compositions according to the invention are adjusted to the required viscosity by the addition of a suitable thickener, for example a water-soluble polyethylene glycol having a molecular weight of from $10^5$ to $4\times10^6$, and preferably of from $4\times10^5$ to $9\times10^5$. Thickeners such as these are commercially available, for example under the tradename Polyox ® (Union Carbide). Other suitable thickeners include, for example, Efacos GT 282 ® (Akzo), a nonionic polymer (dialkylpolyglycol) having an average molecular weight of approximately 3000, for example, various Carbopol ® types (B. F. Goodrich) as representatives of the polycarboxylates, layer silicates, such as for example Laponite RD ® (Laporte Ind. Ltd.), attapulgite clays, such as for example Attagel 40 ® (Chemie-Mineralien KG), polysaccharides, such as for example Kelzan ® (Kelco) or Rhodopol 23 ® (Rhone Poulenc Ind.), cellulose derivatives, such as for example Tylose H200YP ® (Hoechst AG), $C_{12}$–$C_{20}$ fatty alcohol ethoxylates containing approximately 40 to 150 ethylene oxide units.

To adjust the preparations according to the invention to the preferred pH range of 3 to 6, a small quantity of an acid or a salt is added as required. pH regulators suitable for this purpose include acetic acid, citric acid, lactic acid, and tartaric acid. To adjust an exact pH value, it may be necessary to add a small quantity of, for example, sodium hydroxide, sodium hydrogen carbonate or sodium carbonate. The compositions according to the invention are clear, cloudy or opaque solutions, depending on the formulations.

The present invention also relates to a process for washing stubbornly soiled dishes wherein the soiled areas are coated with the preparation of the afore-mentioned type, the dishes are placed in a crockery basket of a dishwashing machine with the coated surface facing towards the stream of circulating water, and the normal machine dishwashing process is started after a contact time of any duration, preferably after at least 30 minutes, and completed.

The test results presented in the following illustrate the advantages of the pretreatment or steeping preparations according to the invention. For the following evaluations, a domestic automatic dishwashing machine of the Miele G 520 type was used. The pots with the test soils described hereinafter were washed in the washing cycle at 55° C. and, for better comparability, without any rinse aid. Four pots per washing cycle (pot opening towards the spray jet, in the present case downwards) were placed in the lower crockery basket of the dishwashing machine.

The effect of the pretreatment or steeping preparation according to the invention was compared with the performance obtained from 30 g of a standard dishwashing detergent alone consisting of:

40% by weight of pentasodium tripolyphosphate, anhydrous,
45% by weight of sodium metasilicate, anhydrous,
5% by weight sodium carbonate, anhydrous,
1% by weight trichloroisocyanuric acid,
1% by weight of an adduct of 5 moles ethylene oxide (EO) and 4 moles of propylene oxide (PO) with a $C_{12}$–$C_{14}$ fatty alcohol, and the remainder, water.

After the dishwashing process using the detergent alone, there were still food remains in the untreated pots. However, if the test soils were treated with one of the steeping preparations according to the invention before the pots were loaded into the dishwashing machine, and if the pots were placed in the lower crockery basket of the dishwashing machine with their openings facing the inflowing water stream, and if the dishwashing process was started after a contact time of the preparation according to the invention of at least about 30 minutes or overnight, soil removal showed a distinct improvement over the standard detergent alone.

The pretreated, clean pots were then visually compared with the untreated, clean pots (blank value) by five examiners who awarded marks on the following scale:

0=blank value (standard detergent),
1=better than the blank value,
2=distinctly better than the blank value, and
3=far better than the blank value.

The test soils were applied mainly to enamel pots 16 cm in diameter and 8 cm deep of the type made by Silit. Other tests were carried out on fine steel pots 16 cm in diameter and 16 cm deep.

With all the formulations shown in Table 1, the average mark awarded for soil removal was between 1 and 3.

PREPARATION OF THE TEST SOILS

Chocolate pudding

| | | | |
|---|---|---|---|
| 2.7 | g | chocolate pudding powder | mixture 1 |
| 2 | g | refined sugar crystals | |
| 6 | ml | water | |
| 17.5 | ml | distilled water | mixture 2 |
| 20 | ml | milk (3.5% fat) | |

Mixture 2 was placed in a cooking pot and heated for 1 minute on an oil bath (200° C.). The pot was removed from the heat source and mixture 1 was stirred in using a wooden spoon. The stirred pudding was then left on the oil bath for 10 minutes without stirring to burn on.

Minced meat 150 g fat-free minced beef
1 egg
50 ml distilled water

All the ingredients were mixed, quantities of 20 g of the resulting mixture were weighed into each cooking pot and uniformly spread over the bottom of the pots. The minced meat was burnt on by leaving the pots on the oil bath for 12 minutes at 200° C.

Cheese 1 egg
10 g cheese (grated, mixture of Emmenthal and Gouda, approx. 40% fat)

The egg and the cheese were whisked together, quantities of 20 g of the mixture were weighed into each pot and uniformly spread over the bottom of the pots. The pots were then left standing on the oil bath (200° C.) for 15 minutes.

Examples of the preprations according to the invention are shown in Table 1 below. The following commercial products were used:

| | |
|---|---|
| Dehypon LS 54 ® = (Henkel/Dehydag) | reaction product of 4 moles propylene oxide with an adduct of 5 moles ethylene oxide and a $C_{12}$–$C_{18}$ fatty alcohol |
| Dehypon LT 104 ® = (Henkel/Dehydag) | adduct of 10 moles ethylene oxide with a $C_{12}$–$C_{18}$ fatty alcohol ter- |

-continued

| | |
|---|---|
| | minally etherified with butyl alcohol |
| Laponite RD ® = (Laport Ind. Ltd) | gel-forming sodium magnesium silicate with strong thixotropicizing effect; pH value of a 2% dispersion in water: 8.2 |
| Carbopol 941 ® = (B. F. Goodrich) | high molecular weight carboxyvinyl polymer |
| Dapral GT 282 S ® = (Akzo Chemie) | hydrolysis-sensitive thickener of polyalkylene glycol, molecular weight ~3000 |
| Kelzan ® = (Kelco) | polysaccharide (xanthan gum) |
| Polyox WSR 205 ® = (Union Carbide) | polyethylene glycol, average molecular weight 600,000 |
| Tylose H 200 YP ® = (Hoechst AG) | hydroxyethyl cellulose |

TABLE 1

Examples of steeping preparations

| Raw material | no. 1 | 2 | 3 | 4 | 5 | 6 | 7 | 8 | 9 | 10 |
|---|---|---|---|---|---|---|---|---|---|---|
| Dehypon LS 54 ® | 10 | 5 | — | 5 | 15 | 15 | 4.5 | 20 | 10 | 10 |
| Dehypon LT 104 ® | — | — | 5 | — | — | — | — | — | — | — |
| Glycerol | 10 | 5 | 5 | 5 | 15 | 15 | 4.5 | 10 | 20 | 10 |
| Laponite RD ® | 1 | 0.5 | 1 | — | — | — | 0.9 | — | — | — |
| Tylose H200YP ® | 2 | 1 | 1 | 1 | — | — | 0.9 | — | — | — |
| Limonene/perfume oil | 2 | — | 1.5 | 1.5 | — | — | — | 0.3 | 0.3 | 0.3 |
| Polyox WSR 205 ® | — | — | — | — | 0.2 | — | — | — | — | 0.5 |
| Carbopol 941 ® | — | — | — | — | — | 0.5 | — | — | — | — |
| Dapral GT 282 S ® | — | — | — | — | — | — | 2.7 | — | — | — |
| Kelzan ® | — | — | — | 0.2 | — | — | — | — | — | — |
| Na cumene sulfonate | — | — | — | — | 1.5 | 3.3 | — | 4 | 4 | — |
| Citric acid | + | + | + | + | + | + | + | + | + | + |
| NaOH | — | — | — | — | — | — | — | — | — | — |
| Viscosity [mPa.s.] | highly viscous jelly | ~100 | ~180 | jelly | ~80 | ~110 | ~500 | <50 | <50 | <50 |
| pH value | 4.0 | 5.0 | 5.0 | 5.0 | 5.0 | 4.0 | 4.5 | 4.3 | 4.5 | 4.5 |

| Raw material | no. 11 | 12 | 13 | 14 | 15 | 16 | 17 | 18 | 19 |
|---|---|---|---|---|---|---|---|---|---|
| Dehypon LS 54 ® | 15 | — | 10 | 10 | 25 | 5 | 20 | 25 | 3 |
| Dehypon LT 104 ® | — | 10 | — | — | — | — | — | — | — |
| Glycerol | 15 | 5 | 10 | 10 | 5 | 25 | 20 | 25 | 2 |
| Laponite RD ® | — | — | — | — | — | — | — | — | — |
| Tylose H200YP ® | — | — | — | — | — | — | — | — | — |
| Limonene/perfume oil | — | 0.4 | 1.5 | 1.5 | 0.5 | 0.5 | 0.7 | 0.7 | 0.7 |
| Polyox WSR 205 ® | — | — | 0.4 | — | — | — | — | 0.05 | — |
| Carbopol 941 ® | 0.4 | — | — | — | — | — | 0.1 | — | — |
| Dapral GT 282 S ® | — | 2 | 3 | 5 | 1 | 1 | — | — | 4 |
| Kelzan ® | — | — | — | — | — | — | — | — | — |
| Na cumene sulfonate | 7 | 3 | 3 | 4 | 4 | 4 | 4 | 4 | 4 |
| Citric acid | + | + | + | + | + | + | + | + | + |
| NaOH | — | — | — | — | — | — | — | — | — |
| Viscosity [mPa.s.] | ~50 | ~60 | ~250 | ~350 | ~50 | ~50 | ~50 | ~50 | ~280 |
| pH value | 4.1 | 4.5 | 3.9 | 4.5 | 4.0 | 4.0 | 3.9 | 4.5 | 3.5 |

TABLE 2

| Example no. | Averages of the marks awarded for removal of the following soils: Pudding | Minced meat | Cheese |
|---|---|---|---|
| 1 | 2 | 2 | 2 |
| 2 | 2 | 1 | 1 |
| 3 | 2 | 1 | 1 |
| 4 | 2 | 2 | 2 |
| 5 | 1 | 1 | 1 |
| 6 | 2 | 2 | 1 |
| 7 | 2 | 1 | 1 |
| 8 | 1 | 2 | 1 |
| 9 | 1 | 2 | 2 |
| 10 | 3 | 3 | 1 |
| 11 | 1 | 1 | 1 |
| 12 | 3 | 2 | 1 |
| 13 | 3 | 1 | 1 |

TABLE 2-continued

| Example no. | Averages of the marks awarded for removal of the following soils: Pudding | Minced meat | Cheese |
|---|---|---|---|
| 14 | 3 | 2 | 1 |
| 15 | 1 | 1 | 1 |
| 16 | 1 | 1 | 1 |
| 17 | 2 | 2 | 1 |
| 18 | 1 | 1 | 2 |
| 19 | 2 | 2 | 1 |

We claim:

1. A process for cleaning stubbornly soiled dishes comprising applying to said dishes a pretreatment or steeping preparation comprising from about 0.5 to about 20% by weight of a low-foaming nonionic surfactant, from about 0.5 to about 25% by weight of a polyhydric alcohol or glycol ether, from about 0.5 to about 10% by weight of a hydrotropic compound, and from about 0.01 to about 6% by weight of a viscosity regulator, all weights based on the weight of said preparation, in the form of an aqueous suspension or solution adjusted to a viscosity of at least 5 mPa.s. and to a pH of from about 3 to about 6; placing the dishes in the crockery basket of an automatic dishwashing machine at room temperature with the coated soiled surface of the dishes facing the outlet of a stream of circulating water in the dishwashing machine, waiting at least about 30 minutes prior to starting said dishwashing machine, and starting the dishwashing machine for its normal washing cycle.

2. A process as in claim 1 wherein said nonionic surfactant is selected from an adduct of propylene glycol having a molecular weight of from about 900 to about 4,000 and from about 1 to about 10 moles of ethylene oxide, an adduct of about 1 to about 10 moles of ethylene oxide and about 1 to about 7 moles of propylene oxide with a fatty alcohol containing from about 8 to about 22 carbon atoms in the molecule, and mixtures thereof.

3. A process as in claim 1 wherein said polyhydric alcohol or glycol ether is selected from ethylene glycol, diethylene glycol, propylene glycol, dipropylene glycol, diethylene glycol monobutylether, and glycerol.

4. A process as in claim 1 wherein said hydrotropic compound is selected from a short-chain monohydric alcohol containing from 2 to 4 carbon atoms in the molecule, octylsulfate, benzene, xylene, toluene, cumene sulfonate, and a polydiol having a molecular weight of up to about 1,000.

5. A process as in claim 1 wherein said viscosity regulator is selected from a water-soluble polyethylene glycol having a molecular weight of from about $10^5$ to about $4\times10^6$.

6. A process as in claim 1 wherein said pH is adjusted with a pH regulator selected from acetic acid, citric acid, lactic acid, tartaric acid, sodium hydroxide, sodium hydrogen carbonate, and sodium carbonate.

* * * * *